United States Patent [19]

Schmitt

[11] Patent Number: 4,562,759

[45] Date of Patent: Jan. 7, 1986

[54] UNIVERSAL CAM FOR KEY CUTTING MACHINE

[76] Inventor: Thomas W. Schmitt, 316 N. 111th St., Wauwatosa, Wis. 53226

[21] Appl. No.: 576,276

[22] Filed: Feb. 2, 1984

[51] Int. Cl.[4] ..... B26F 1/12

[52] U.S. Cl. ..... 83/414; 83/917; 30/131

[58] Field of Search ..... 83/412, 414, 693, 556, 83/560, 917; 30/131

[56] References Cited

U.S. PATENT DOCUMENTS

| | | | |
|---|---|---|---|
| 1,995,798 | 3/1935 | Curtis | 30/131 |
| 2,626,663 | 1/1953 | Abrams | 30/131 |
| 2,731,087 | 1/1956 | Cole | 83/917 |
| 3,496,636 | 2/1970 | Lieptz | 83/917 |
| 3,769,865 | 11/1973 | Kleist | 83/414 |
| 3,785,234 | 1/1974 | Sitte | 83/414 |
| 3,884,121 | 5/1975 | Agius | 83/917 |

*Primary Examiner*—Frank T. Yost
*Assistant Examiner*—Hien H. Phan
*Attorney, Agent, or Firm*—Andrus, Sceales, Starke & Sawall

[57] ABSTRACT

An adjustable depth gauge assembly for a key cutting device includes a rotatable gauge or cam member carried by a vertically and transversely movable key blank support that sequentially positions a key blank in selected cutting relationship to a cutting punch or die. The gauge or cam member includes a continuous uninterrupted cam surface which is sequentially engageable with a finger or pin disposed in the path of movement of the gauge member to selectively limit vertical movement of the key blank support. The gauge assembly also includes an indicator arm for rotating the gauge member to a desired position so that the depth of cuts in a key blank may be varied in accordance with a pre-established code pattern.

3 Claims, 5 Drawing Figures

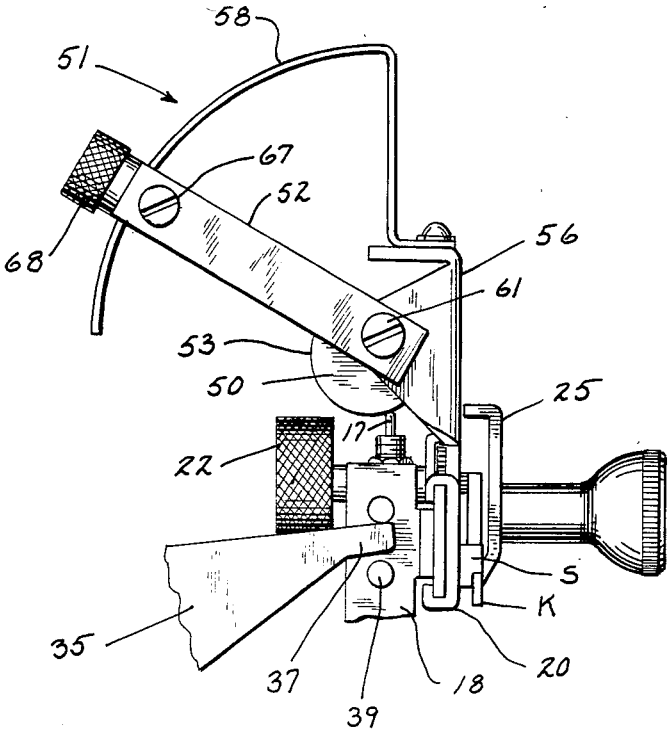
FIG. 3
FIG. 4
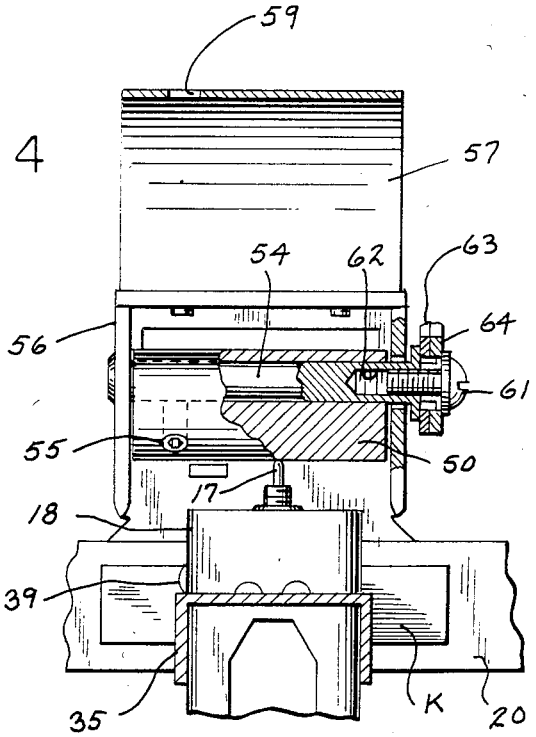
FIG. 5
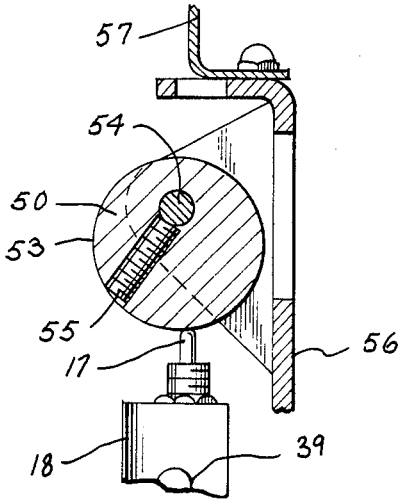

UNIVERSAL CAM FOR KEY CUTTING MACHINE

BACKGROUND OF THE INVENTION

The present invention relates to key cutting devices, and more particularly to an adjustable depth gauge assembly for a key cutting device.

Various types of key cutting devices are known in the art. One type is called a "duplicator" which utilizes an existing cut key as a pattern for reproducing the same sequence of cuts in a matching key blank. Another type of key cutting device is called a "code cutter" which utilizes a key or lock number and coded key cuts information to establish settings on a machine which will provide the desired sequence of cuts in a matching key blank. This latter type of device does not require an existing cut key as a pattern. Both of the above types of key cutting devices can be either manually or power operated and can be either partially or fully automated. Examples of various types of code cutting machines may be found in U.S. Pat. Nos. 3,496,636, 3,633,451 and 3,722,341.

U.S. Pat. Nos. 3,496,636 and 3,633,451 both illustrate a key cutting device that includes a depth gauge assembly which permits the entire code of depth cuts for a specific key to be set on the machine through individually adjustable gauging elements or cams before any cuts are made. In this type of device, however, one must employ a separate depth gauge assembly for each manufacturer's code pattern. For example, if a locksmith desired to have the capability to cut keys for automobiles, the locksmith would need a separate gauge assembly for each automobile manufacturer.

SUMMARY OF THE INVENTION

An adjustable depth gauge assembly for a key cutting device of the "code cutting" type. The depth gauge assembly includes a rotatable gauge or cam member carried by a vertically and transversely movable key blank support that sequentially positions a key blank in selected cutting relationship to a cutting punch or die. The gauge or cam member includes a continuous or uninterrupted cam surface which is sequentially engageable with an abutment means disposed in the path of movement of the gauge or cam member to selectively limit vertical movement of the key blank support. The depth gauge assembly also includes means for rotating the gauge or cam member to a desired position so that the depth of cuts in a key blank may be varied in accordance with a preestablished code pattern.

The gauge or cam member is rotatable about an eccentrically positioned shaft and includes a cylindrical outer surface that defines the cam surface. The means for rotating the gauge member includes an arm connected to the cam shaft which extends transversely with respect to the shaft. The arm includes an indicator at its free end which cooperates with a scale located on a bracket carried by and movable with the key blank support. This arm enables a user to move the gauge or cam member to a desired position in accordance with the preestablished code pattern for the particular key to be reproduced. The gauge assembly also includes a locking means for locking the gauge member in the desired position during each cut.

The present invention thus provides a key cutting device having an adjustable depth gauge assembly which provides a universal assembly for use with all key manufacturers' codes.

BRIEF DESCRIPTION OF THE DRAWING

The drawings illustrate the best mode presently contemplated of carrying out the invention.

In the drawings:

FIG. 3 is a fragmentary side view in elevation of the depth gauge assembly as seen from the opposite side from that of FIG. 1;

FIG. 4 is a fragmentary rear view with parts broken away and in section illustrating the assembly of the cam member and indicator arm for the depth gauge assembly; and FIG. 5 is a fragmentary sectional view taken through the cam member of FIG. 4.

DESCRIPTION OF THE PREFERRED EMBODIMENT

Figure 1:
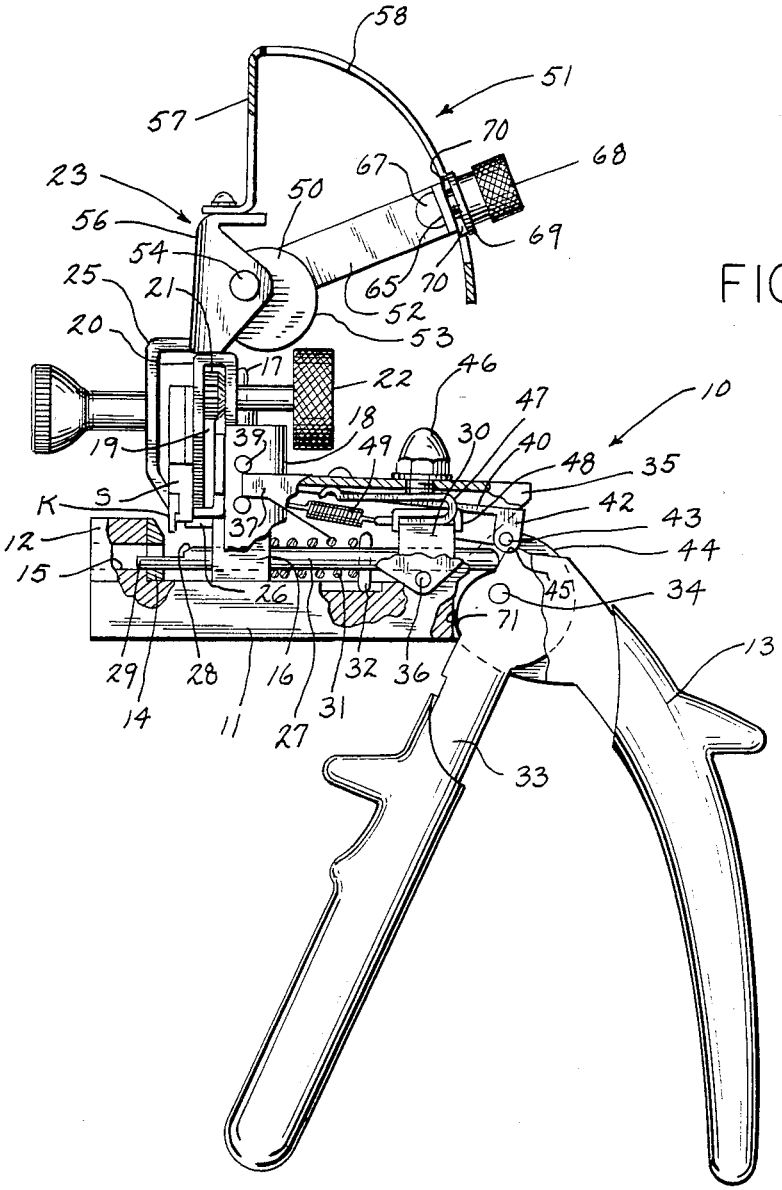
FIG. 1 is a side view in elevation with parts broken away and in section of a key cutting device which incorporates a depth gauge assembly in accordance with the principles of the present invention.

Referring to the drawings, there is shown a key-cutting machine 10 having a frame or body 11 which has, at one end thereof, an upwardly projecting portion or block 12 and at the other end thereof a depending handgrip portion 13. Secured to the rearward face of block 12 is a wear surface or anvil 14 having a longitudinally extending aperture 15 therein which also extends through block 12. Projecting upwardly from body 11 rearwardly of anvil 14 is a pillar or post 16 which is surmounted by a finger or upwardly projecting abutment 17.

A sleeve or saddle member 18 is slidably mounted on post 16 for vertical movement relative to body 11. A toothed rack 19 is fixedly secured to saddle member 18 and serves as a guide rail or track for traversing movement of a key blank support member 20 which is slidably mounted on rack 19. Support member 20 carries a pinion 21 which operatively engages toothed rack 19 and is manipulated by a hand wheel 22 to effect transverse movement of support member 20 relative to rack 19.

The upper portion of support member 20 is provided with a depth gauge assembly 23 which can be adjusted to establish a predetermined depth of cut for each transverse position of support member 20. The depth gauge assembly 23 overlies the abutment or finger 17 which is disposed in the path of downward movement of support member 20 and engages the depth gauge assembly 23 to limit the extent of downward movement of support member 20. The forward face of support member 20 is provided with suitable means, such as apertures (not shown) for detachably receiving and positioning any one of many different types of key blank carriages S, depending upon the nature and characteristics of the style of key blank K which is mounted on the carriage and is to be cut in machine 10. A screw-operated clamping element 25 is mounted on support member 20 to releasably retain carriage S and key blank K in a fixed position on support member 20. A detent spring 26 serves to engage appropriately spaced notches on carriage S to designate the incremental transverse spacing of the cuts on key blank K.

A cutting tool in the form of a die or punch 27 is mounted in the body for slidable longitudinal movement through post 16 and into aperture 15 so that its cutting edge 28 transverses a portion of key blank K which is positioned in its path of movement. Punch 27 is provided with a forward extension 28 which rests in aperture 15 and serves as a guide for the forward end of punch 27 during its cutting movement. The rearward end of punch 27 traverses an upstanding block 30 on the rear of body 11, which serves as a guide or bearing for that end of the punch. A coil spring 31, which bears at one end against the rear face of post 16 and bears at its other end against a diametrical pin 32 on punch 27, serves to yieldably maintain the punch in a retracted position with its rearward end bearing upon the upper end of a force-compounding hand lever 33 which is pivotally secured to body 11 as at 34.

A rocker arm 35 is pivotally secured to body 11 rearwardly of saddle 18, as at 36. The forward end of rocker arm 35 is bifurcated to provide spaced fingers 37 which are movably accommodated and retained in recesses defined by spaced pairs of projections 39 provided on opposite faces of saddle 18. A flexible element 40 has one end thereof fixedly secured to rocker arm 35 to provide a cantilever which extends rearwardly and whose free end is provided with depending ears 42 in which is journaled a friction-reducing roller 43. Roller 43 engages a cam surface 44 provided on the upper end of hand lever 33. Cam surface 44 has a notch or dwell 45 in which the roller is received and rests when the cutting tool 27 is in its retracted position. An adjustable set screw 46 is threadedly mounted on the top wall of rocker arm 35 and projects downwardly into engagement with the upper surface of flexible element 40 at a point intermediate the ends thereof. By rotating screw 46 in one direction or the other to vary its effective length and correspondingly, the extent of force or thrust it exerts upon the flexible element, the degree or extent of stiffness or relative regidity of flexible element 40 can be adjustably regulated.

A wire-form U-shaped spring 47 is suitably affixed to rear block 30, as by plate 48, and has its legs extending forwardly into biasing engagement with the undersurface of rocker arm 35, so as to urge its forward end upwardly. An expansion coil spring 49 extends between the plate 48 and saddle 18 to normally urge rack 19 into abutment with the front surface of post 16. When this abutment condition exists, the opposing surface of saddle 18 is spaced from the rear face of post 16 to provide a predetermined clearance therefrom. The function and purpose of this clearance is to accommodate the support member 20 to variations in the thickness of key blanks, as will be more fully described hereinafter.

The components of the key cutting device described up to this point are known by those skilled in the art, and are substantially identical to those illustrated and described in connection with the aforementioned U.S. Pat. No. 3,633,451. As a unique feature, however, the key cutting device includes the depth gauge assembly 23 which provides a universal assembly for use with all key manufacturers' codes. The depth gauge assembly 23 includes a gauge or cam member 50, a bracket 51 and an indicator arm 52.

Gauge or cam member 50 is a solid cylinder having a cylindrical outer surface 53 that defines a cam surface that engages finger 17 to limit the extent of downward movement of support member 20 as will hereinafter be described. Cam member 50 is mounted on an eccentric shaft 54 by means of a set screw 55 so that member 50 and shaft 54 rotate in unison. Shaft 54 in turn is journaled on a pair of opposing ears integrally formed on a bracket 56 which is carried by support member 20. As shown best in FIG. 5, the axis of rotation of shaft 54 is located at a point which is $\frac{3}{4}$ of the distance of a line running diametrically through member 50. Thus, the rotation of member 50 will vary the vertical distance through which member 50 will move before it engages finger 17. This in turn will vary the vertical distance through which support member 20 moves and consequently vary the depth of cut in key blank K.

Bracket 51 is mounted in a cantilevered fashion to a third ear located at the upper end of bracket 56, and includes a vertically extending leg 57 and an arc shaped leg 58. Leg 57 is L-shaped and is attached by screws or rivets to the top of bracket 56. Leg 58 is integrally formed on the end of leg 57 and extends outwardly and downwardly therefrom as shown best in FIGS. 1 and 3. Leg 58 includes a longitudinally extending slot 59 formed therethrough which extends along the entire length thereof. Indicia 60 located on the outer face or side of leg 58 provide a scale for determining the rotational position of cam member 50 as will hereinafter be described.

Figure 2:
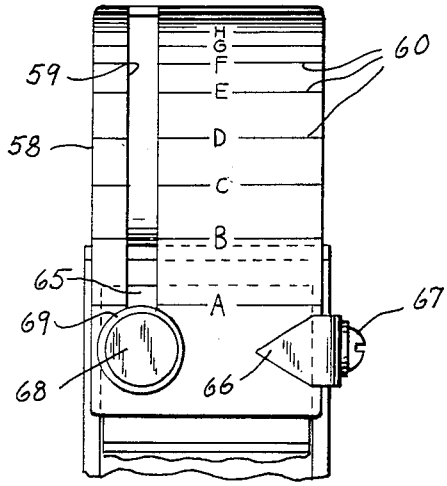
FIG. 2 is a fragmentary rear view illustrating the scale and position indicator for the depth gauge assembly shown in FIG. 1.

Indicator arm 52 functions to provide a means for rotating cam member 50 to a desired position. Arm 52 is mounted at its lower end to shaft 54 and extends in a cantilevered manner therefrom in a direction transverse to the axis of rotation of shaft 54. As best seen in FIG. 4, the connection of arm 52 to shaft 54 is provided by a screw 61 that extends through the lower end of arm 52 into a bore 62 formed axially into the end of shaft 54. As seen best in FIGS. 2 and 4, arm 52 is comprised of a pair of L-shaped members 63 and 64. The inner member 63 includes a plate 65 located at its outer end which is disposed on the inner side of leg 58. The outer arm member 64 includes a head 66 located on the outer side of leg 58. Head 66 tapers to a point so that arm 52 can be lined up with any desired indicia 60 in accordance with a preestablished code setting. Leg member 63 and 64 are connected together at their lower ends by screw 61 and at their outer ends by a screw 67. Thus, movement of arm 52 causes a corresponding rotation of cam member 50 in accordance with the position of head 66.

Gauge assembly 26 also includes a means for locking cam member 50 in the desired position. This locking means is shown best in FIGS. 1–3 and includes a screw 68 having a knurled head positioned on the outside of leg 58 and a shank portion extending through slot 59 and threadedly engaged in plate 65. A washer 69 is positioned between the head of screw 68 and the outside of leg 58. Washer 69 includes a projection 70 on one side thereof which is dimensioned to substantially correspond to the dimensions of slot 59. The projection 70 on washer 69 extends into slot 59 so that a positive lock of cam member 50 and arm 52 is provided when screw 68 is turned into plate 65.

The operation of the cutting machine will now be described. In its normal or inoperative position, punch 27 is retracted and yieldably maintained in such retracted position by compression coil spring 31 to the extent limited by the abutment of hand lever 33 with body 11, as at 71. At this time hand lever 33 is in its forwardmost position. In this fully retracted position for punch 27, its cutting edge 28 is disposed rearwardly of key blank K carried by carriage S on support member 20, so that key blank K is positioned forwardly of the cutting edge 28 between it and the plane of anvil 14. It will be understood that, in this inoperative position, key blank K is not disposed in the path of cutting movement of cutting tool 27, as support member 20 is in its fully elevated position where it is yieldably maintained by the urging of U-spring 47 acting on rocker arm 35. The engagement of roller 43 of flexible element 40 in the dwell portion 45 of hand lever 33 serves to limit the extent of upward movement of the rocker arm fingers 37 and support member 20 on post 16. In this inoperative position, expansion coil spring 49 yieldably maintains saddle 18 in its rearmost position to provide the previously described clearance between it and the rearward face of post 16.

After insertion of the appropriate key blank K and carriage S on support member 20, cam member 50 is rotated to a position which establishes the desired depth of cut for the first notch to be cut in a key blank K in accordance with the code cut pattern for the particular key blank K to be cut. This is accomplished by moving arm 52 until head 66 is aligned with the appropriate indicia 60. Cam member 50 and arm 52 are then locked in position by turning down screw 68. The first notch in key blank K is now ready to be cut.

As hand lever 33 is drawn toward hand grip 13, it displaces the cutting tool 27 to advance it in opposition to spring 31 and simultaneously cams roller 43 to displace the free end of cantilever arm 40 upwardly to cause downward movement of rocker arm fingers 37 in an arcuate movement about the pivot point 36, in opposition to the urging of spring 47. This causes relative downward movement of saddle 18 and support member 20 until cam member 50 of depth gauge assembly 22 comes into abutment with the upstanding finger 17. This point of abutment defines the lowermost position of support member 20. Continued camming displacement of roller 43 will occur as hand lever 33 is retracted to the limit of its rearward position. However, the lost motion permitted by the flexibility of cantilever member 40 allows for this overtravel even though the pivotal movement of rocker arm 35 has been arrested prior to the completion of the full stroke 35 of hand lever 33.

When support member 20 and key blank K have attained their preselected lowermost position, cutting edge 28 of punch 27 has not yet been moved forwardly sufficiently to engage key blank K, although key blank K is now disposed in the path of advancing movement of cutting edge 28. With the spring-loaded arrangement of saddle 18, key blank K is normally maintained rearwardly of the plane of the anvil face regardless of the manufacturing variations of the range normally encountered in the thickness of key blank K. The clearance space between saddle 18 and post 16 is large enough to compensate for the maximum thickness variation from normal which can be expected in any key blank. It will be noted that when fingers 37 pivot downwardly to lower support member 20, they also have a forward vector of movement which, to some extent, displaces saddle 18 forwardly toward the rear face of post 16 as support member 20 reaches its lower limit of position. However, the primary forward displacement of saddle 18 occurs as a result of the advancing engagement of cutting edge 28 with key blank K which forces key blank K into full surface abutment with anvil 14 in opposition to the action of spring 49. The yieldably maintained clearance between saddle 18 and post 16 is sufficient to permit this forward displacement.

As soon as hand lever 33 is initially released, coil spring 31 causes cutting member 27 to retract and simultaneously spring 47 urges saddle 18 and support member 20 upwardly out of the path of retractive movement of punch 27 while spring 49 urges saddle 18 and support member 20 rearwardly. This movement of the key blank is sufficient to prevent any binding or jamming between key blank K and the retracting punch 27.

As hand lever 33 is further released, cutting tool 27 and support member 20 are restored to their initial positions at which the described operating cycle was started. The hand wheel 22 is now rotated to cause traversing movement of support member 20 to the detent position defining the second cutting position for key blank K and the operating cycle is repeated with the abutment finger 17 now being disposed in the path of movement of cam member 50 but at a location just adjacent to its original position. Cam member 50 is then rotated to a second position which establishes the desired depth of cut for the second notch to be cut in key blank K. This is accomplished by loosening screw 68 and moving arm 52 to the next desired code position. This operative cycle is repeated until all the required cuts have been made.

Various modes of carrying out the invention are contemplated as being within the scope of the following claims particularly pointing out and distinctly claiming the subject matter which is regarded as the invention.

I claim:

1. An adjustable depth gauge assembly for a key-cutting device having a vertically and transversely movable key blank support means mounted on a body that sequentially positions a key blank in selected cutting relationship to a cutting means, the combination comprising:

a rotatable gauge member carried by and movable with said key blank support means, said gauge member includes a cylinder member having a continuous uninterrupted cylindrical outer surface that defines a cam surface sequentially engageable with an abutment means carried by said body to selectively limit vertical movement of said key blank support means, said cylinder member is rotatable on a shaft defining an eccentric axis extending longitudinally through said cylinder member and transversely with respect to said body;

means for rotating said gauge member to a desired position to vary the depth of cuts in a key blank in accordance with a pre-established code pattern, said means for rotating said gauge member includes an arm connected to said shaft that extends transversely with respect to said shaft, said arm includes indicator means at its free end, and further including a bracket member carried by and movable with said key blank support means in a canteilevered manner which includes a scale thereon for cooperation with said indicator means so that said gauge member is rotated to a desired position in accordance with said preestablished code pattern; and means for locking said gauge member in the desired position, wherein the free end of said bracket member is arc-shaped and includes a longitudinally extending slot therein, and said locking means includes a plate member connected to said arm and extending along one side of the arc-shaped end of said bracket, a screw member having a head positioned on the other side of the arc-shaped end of said bracket member and a shank portion extending through said slot and threadedly engaged in said plate member, and a washer member positioned between said head and said other side of said bracket member, said washer member including a projection extending into said slot so that a positive lock of said gauge member is provided when said screw member is turned into said plate member.

2. An apparatus for cutting a key from a key blank in accordance with a preestablished code pattern, comprising:

a body;

a movable cutting means carried by said body;

a vertically and transversely movable key blank support means carried by said body for sequentially positioning a key blank in selected cutting relationship to said cutting means;

first means for actuating said cutting means;

second means responsive to the operation of said first means for moving said key blank support means into and out of said cutting relationship;

a rotatable gauge member carried by and movable with said key blank support means, said gauge member includes a cylinder member having a cylindrical outer surface that defines a continuous uninterrupted cam surface, said cylinder member is rotatable on a shaft defining an eccentric axis extending longitudinally through said cylinder member and transversely with respect to said body;

third means for rotating said gauge member to a desired position, said third means for rotating said gauge member includes an arm connected to said shaft that extends transversely with respect to said shaft, said arm includes indicator means at its free end, and further including a bracket member carried by and movable with said key blank support means in a cantilevered manner which includes a scale thereon for cooperation with said indicator means so that said gauge member is rotated to a desired position in accordance with said pre-established code pattern;

means for locking said gauge member in the desired position, wherein the free end of said bracket member is arc-shaped and includes a longitudinally extending slot therein, and said locking means includes a plate member connected to said arm and extending along one side of the arc-shaped end of said bracket, a screw member having a head positioned on the other side of the arc-shaped end of said bracket member and a shank portion extending through said slot and threadedly engaged in said plate member, and a washer member positioned between said head and said other side of said bracket member, said washer member including a projection extending into said slot so that a positive lock of said gauge member is provided when said screw member is turned into said plate member; and abutment means on said body positioned in the path of movement of said gauge member and sequentially engageable with said cam surface to selectively limit vertical movement of said key blank support means into a key cutting position to vary the depth of cuts in a key blank.

3. An apparatus for cutting a key from a key blank in accordance with a pre-established code pattern, comprising:

a body;

a movable cutting means carried by said body;

a vertically and transversely movable key blank support means carried by said body for sequentially positioning a key blank in selected cutting relationship to said cutting means;

first means for actuating said cutting means;

second means responsive to the operation of said first means for moving said key blank support means into and out of said cutting relationship;

a rotatable gauge member carried by and movable with said key blank support means, said gauge member includes a cylinder member having a cylindrical outer surface that defines a continuous uninterrupted cam surface, said cylinder member is rotatable on an eccentrically positioned shaft extending longitudinally through said cylinder member and transversely with respect to said body;

third means for rotating said gauge member to a desired position, said third means includes an arm connected to said shaft that extends transversely with respect to said shaft, said arm includes indicator means at its free end;

abutment means on said body positioned in the path of movement of said gauge member and sequentially engageable with said cam surface to selectively limit vertical movement of said key blank support means into a key cutting position to vary the depth of cuts in a key blank;

a bracket member carried by and movable with said key blank support means in a cantilevered manner which includes a scale thereon for cooperation with said indicator means so that said gauge member is rotated to a desired position in accordance with said pre-established code pattern, the free end of said bracket member is arc-shaped and includes a longitudinally extending slot therein; and means for locking said gauge member in the desired position, said locking means includes a plate member connected to said arm and extending along one side of the arc-shaped end of said bracket, a screw member having a head positioned on the other side of the arc-shaped end of said bracket member and a shank portion extending through said slot and threadedly engaged in said plate member, and a washer member positioned between said head and said other side of said bracket member, said washer member including a projection extending into said slot so that a positive lock of said gauge member is provided when said screw member is turned into said plate member.

* * * * *